US007010254B2

(12) United States Patent
Takeuchi et al.

(10) Patent No.: US 7,010,254 B2
(45) Date of Patent: Mar. 7, 2006

(54) IMAGING FORMING APPARATUS

(75) Inventors: Akihiko Takeuchi, Shizuoka-ken (JP); Tatsuya Kobayashi, Shizuoka-ken (JP); Naoki Enomoto, Ibaraki-ken (JP); Takehiko Suzuki, Shizuoka-ken (JP); Takamitsu Soda, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/743,405

(22) Filed: Dec. 23, 2003

(65) Prior Publication Data

US 2004/0156657 A1 Aug. 12, 2004

(30) Foreign Application Priority Data

Dec. 26, 2002 (JP) ..... 2002-375875

(51) Int. Cl.
*G03G 15/01* (2006.01)

(52) U.S. Cl. ..... 399/302; 399/66; 399/299

(58) Field of Classification Search ..... 399/302, 399/299, 66

See application file for complete search history.

(56) References Cited

U.S. PATENT DOCUMENTS

| | | | | |
|---|---|---|---|---|
| 5,600,423 | A | 2/1997 | Miyashiro et al. | 399/313 |
| 5,809,387 | A | 9/1998 | Takeuchi et al. | 399/302 |
| 6,091,913 | A | 7/2000 | Suzuki et al. | 399/49 |
| 6,222,566 | B1 * | 4/2001 | Takeyama et al. | 347/116 |
| 6,332,066 | B1 * | 12/2001 | Yanagawa | 399/302 |
| 6,336,026 | B1 * | 1/2002 | Heeks et al. | 399/302 |
| 6,427,062 | B1 | 7/2002 | Takeuchi | 399/388 |
| 6,477,339 | B1 * | 11/2002 | Yano et al. | 399/66 |
| 6,556,797 | B1 | 4/2003 | Nishigaki et al. | 399/130 |
| 6,574,442 | B1 | 6/2003 | Kibune | 399/49 |
| 2001/0051055 | A1 * | 12/2001 | Omata et al. | 399/66 |
| 2003/0063921 | A1 | 4/2003 | Saito et al. | 399/121 |
| 2003/0219286 | A1 | 11/2003 | Soda et al. | 399/297 |

FOREIGN PATENT DOCUMENTS

JP 2002214872 A * 7/2002

* cited by examiner

*Primary Examiner*—Arthur T. Grimley
*Assistant Examiner*—Peter Lee
(74) *Attorney, Agent, or Firm*—Fitzpatrick, Cella, Harper & Scinto

(57) ABSTRACT

An image forming apparatus includes an image carrying member and an intermediate transfer body in an endless shape movable and receivable of toner images from said image carrying member at first and second transfer positions. The following relationship is satisfied where a distance from the first transfer position to the second transfer position along the moving direction of the intermediate transfer body is denoted as Lab, a circumference of the intermediate transfer in the moving direction is denoted as Lr, and a length of the toner image formed on the intermediate transfer body is denoted as Lm−Lr−Lm>Lab.

9 Claims, 5 Drawing Sheets

IMAGING FORMING APPARATUS

BACKGROUND OF THE INVENTION (a) Field of the Invention

This invention relates to an image forming apparatus such as a printer, a photocopier, and a facsimile machine and, more particularly, to an apparatus utilizing an intermediate transfer body.

(b) Description of Related Art

As image forming apparatuses of a full-color electrophotographic method, an apparatus has been known in which plural toner images are sequentially formed on a single photosensitive body and are overlapped on an intermediate transfer body to form full color images. More specifically, the apparatus is described with reference to FIG. 5. Developing devices 4*a*, 4*b*, 4*c*, 4*d* having respective toners of different colors are sequentially arranged as to face to an image carrying means 1 as a single photosensitive drum, thereby sequentially forming the toner images of the respective colors. The toner images of the respective colors are sequentially overlapped onto the intermediate transfer body 61 from the image carrying means 1, and the toner images overlapped on the intermediate transfer body 61 are transferred onto a transfer material P with a secondary transfer roller 66. Then, the transfer material carrying the toner images is made through a fixing device 8, and thereby the image forming apparatus is practically used for obtaining permanently fixed images upon application of heat and pressure at the fixing device. Where four color toners are used to form full-color images, the apparatus has a structure that the toner image is overlapped four times on the intermediate transfer body to form images. This apparatus is of, so-called, a four-pass system.

The image forming apparatus described above necessarily rotates the intermediate transfer body for a number of times equal to the number of the colors of the overlapping toners to overlap the toner images, so that the productivity is not so high. As an image forming apparatus whose productivity is improved and whose size is not significantly large, an image forming apparatus exists in which plural photosensitive bodies are provided and in which two rotations of the intermediate transfer body make the toner images of the desired color number overlapped in the intermediate transfer body. This apparatus is of, a so-called, two-pass system. Where, for example, images with overlapped four-color toners are formed, the image forming apparatus forms the toner images in which the four-color toners are overlapped by two rotations of the intermediate transfer body where formed with two photosensitive bodies and where the toner images of two-colors are carried on the intermediate transfer body at each rotation of the intermediate transfer body. That is, in this case, the apparatus ensures advantageously productivity twice to that of the image forming apparatus having a single photosensitive body.

With this apparatus, however, image formation requires two rotations of the intermediate transfer body, and the following problems may be raised where images are successively formed on plural sheets. There may raise a problem that both transfer operations are interfering with each other where the fourth color toner image of a previous image is transferred from one photosensitive body to an intermediate transfer body and at the same time the first color toner image of the subsequent image is transferred from the other photosensitive body to the intermediate transfer body. That is, the transfer operation of one body may affect the transfer operation of the other body. With this interference at the transfer operation, transfer defects may occur.

SUMMARY OF THE INVENTION

This invention is to prevent such interference from occurring at the transfer operation. This invention, particularly for an image forming apparatus equipped with plural image carriers as image carrying means in aiming at improvements in productivity, is to solve the above problems without reducing the productivity.

It is another object to provide an image forming apparatus including an image carrying members; and an intermediate transfer body in an endless shape movable and receivable of toner images from said image carrying members at first and second transfer positions, wherein a toner image formed on said intermediate transfer body is transferred onto a transfer material after passing said first transfer position and said second transfer position again, wherein said first transfer position is a position for transferring to said intermediate transfer body from a nearest image carrying member on a downstream side in a moving direction of said intermediate transfer body with respect to a position that the toner image is transferred from said intermediate transfer body to the transfer material, wherein said second transfer position is a position for transferring to said intermediate transfer body from the nearest image carrying member on an upstream side in the moving direction of said intermediate transfer body with respect to a position that the toner image is transferred from said intermediate transfer body to the transfer material, wherein the following relationship is satisfied where a distance from said first transfer position to said second transfer position along the moving direction of said intermediate transfer body is denoted as Lab, a circumference of said intermediate transfer body in the moving direction is denoted as Lr, and a length of said toner image formed on said intermediate transfer body is denoted as Lm:

$Lr-Lm>Lab$, and wherein a toner image of an image is transferred onto said intermediate transfer body after toner images of the previous image are entirely formed on said intermediate transfer body where the toner images are formed successively.

It is yet another object to provide an image forming apparatus including image carrying members; and an intermediate transfer body in an endless shape movable and receivable of toner images from said image carrying members at first and second transfer positions, wherein a toner image formed on said intermediate transfer body is transferred onto a transfer material after passing said first transfer position and said second transfer position again, wherein said first transfer position is a position for transferring to said intermediate transfer body from a nearest image carrying member on a downstream side in a moving direction of said intermediate transfer body with respect to a position that the toner image is transferred from said intermediate transfer body to the transfer material, wherein said second transfer position is a position for transferring to said intermediate transfer body from the nearest image carrying member on an upstream side in the moving direction of said intermediate transfer body with respect to a position that the toner image is transferred from said intermediate transfer body to the transfer material, wherein the following relationship is satisfied where a distance from said first transfer position to said second transfer position along the moving direction of said intermediate transfer body is denoted as Lab, a circumference of said intermediate transfer body in the moving direction is denoted as Lr, and a length of said toner image formed on said intermediate transfer body is denoted as Lm:

$Lr-Lm \leqq Lab$, and wherein a toner image forming position on said intermediate transfer body is moved on a upstream side in the moving direction of said intermediate transfer body at each image formation where the images are formed successively.

Further objects of the invention will be apparent from the following description.

DETAILED DESCRIPTION OF THE PREFERRED EMBODIMENTS

Figure 1:
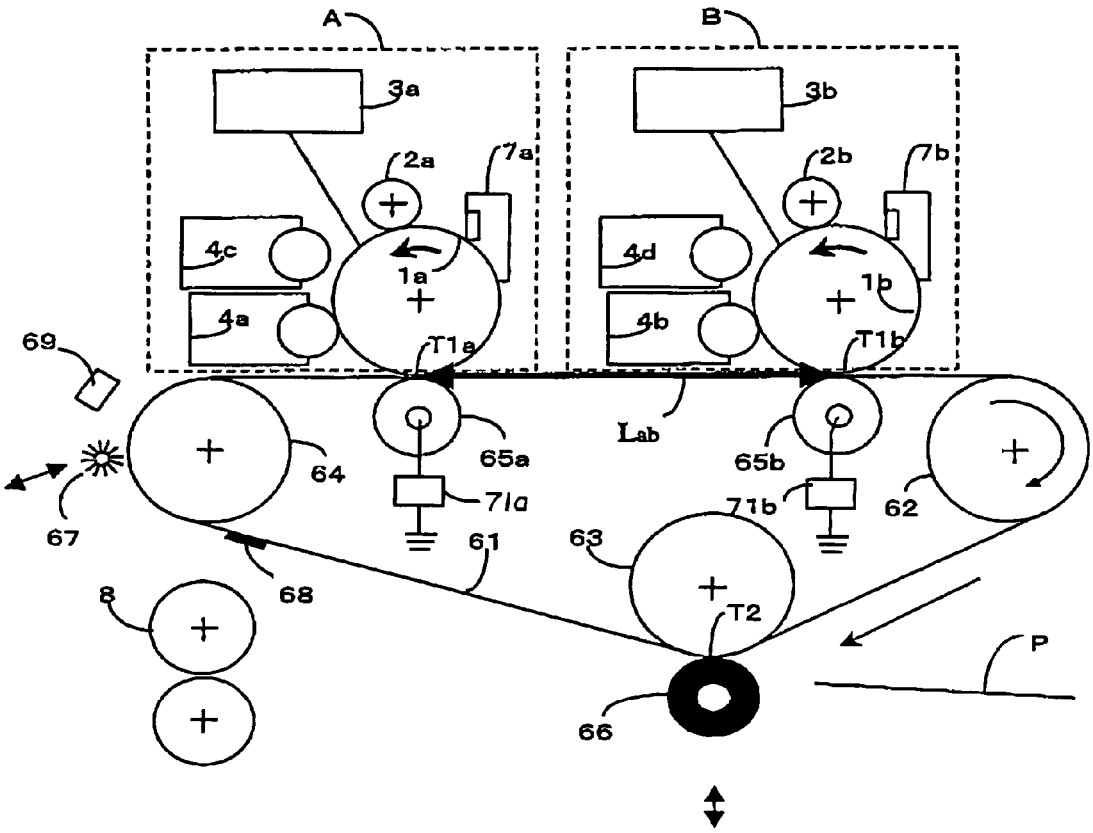
FIG. 1 is an illustration showing an image forming apparatus according to a first embodiment of the invention.

Hereinafter, referring to the drawings, the embodiments according to the invention are described.

[First Embodiment]

FIG. 1 is for a first embodiment of the invention. The embodiment is described with reference to the drawings.

Around an intermediate transfer belt 61, disposed are a first image production section A and a second image production section B, each of which is constituted of a photosensitive drum, a charging device, a charging roller, two switchable developing devices, and a cleaning device.

In the first image production section A, the photosensitive drum 1*a* is charged with the charging roller 2*a*, and the exposing device 3*a* exposes images of the first color yellow. The latent image formed on the photosensitive drum 1*a* is developed by the developing device 4*a* corresponding to the first color yellow. It is to be noted that the developing devices 4*a*, 4*c* are interchangeably used according to a drive means not shown. The developed yellow toner image is transferred to an intermediate transfer belt 61 by a primary transfer roller 65*a* (at a first transfer position). The second image production section B produces an image of the second color magenta so as to match the position of the first color yellow toner image on the intermediate transfer belt 61. The image production is done, in the same manner as that for the first color yellow image formation in the first image production section A described above, by charging the photosensitive drum 1*b* with the charging roller 2*b* and by exposing the image of the second color magenta with the exposing device 3*b*. The latent image formed on the photosensitive drum 1*b* is developed by the developing device 4*b* corresponding to the second color magenta. It is to be noted that the developing devices 4*b*, 4*d* are also interchangeably used according to a drive means not shown. The developed magenta toner image is transferred to the intermediate transfer belt 61 by a primary transfer roller 65*b* (at a second transfer position) so as to match the position of the first color yellow toner image on the intermediate transfer belt 61.

At the first image production section A, the developing devices are switched when the development of the first color yellow finishes, and the developing device 4*c* of the third color cyan comes in contact with the photosensitive drum 1*a*. At the second image production section B, the developing devices are switched when the development of the second color magenta finishes, and the developing device 4*d* of the third color black comes in contact with the photosensitive drum 1*b*. The intermediate transfer belt 61 carrying the toner images of the first color and second color rotates in one rotation and reaches the image production section again, and the third color cyan toner image and the fourth color black toner image are formed at the first image production section A and the second image production section B so as to match the position of the toner image on the intermediate transfer belt 61 and are transferred onto the intermediate transfer belt 61. Where the two-color toner images are transferred onto the toner image placed on the intermediate transfer belt 61 reaching the image production section again, a recording material P is conveyed in synchrony with the movement of the toner image on the intermediate transfer belt 61, and the second transfer roller 66 having isolated during the toner image formation period for forming images on the intermediate transfer belt 61 comes in contact with the intermediate transfer belt 61, thereby clamping the recording medium P therebetween. The four-color toner images on the intermediate transfer belt 61 are transferred at once to the recording medium P. The recording medium P on which the four-color toner image is transferred is subject to melting and fixing with the fixing device 8 for application of heat and pressure publicly known, thereby producing color images.

Transfer remaining toner on the photosensitive drums 1*a*, 1*b* is cleaned up by the cleaning devices 7*a*, 7*b* having a blade means publicly known. Transfer remaining toner on the intermediate transfer belt 61 is also cleaned up by a fur brush cleaning device 67 movable closely to and away from the belt.

As described above, the two-pass method requires only two rotations of the intermediate transfer belt 61 to obtain the full-color image, and a double recording speed is obtainable in comparison with the four-pass method in which the image production section is solely provided.

As a material for the intermediate transfer belt 61, a member using, as an example, a resin or resins such as PI, PVDF, ETFE, ABS, poly carbonate, nylon, etc. having a thickness of 50 to 200 microns, whose resistivity is adjusted properly. The surface resistivity in this case is of $10^7$ Ohm per square ($10^7$ Ω/□) to $10^{12}$ Ohm per square ($10^{12}$ Ω/□). The volume resistivity is $10^7$ Ohm centimeters to $10^{12}$ Ohm centimeters. The resistance of the transfer belt 61 is the result measured using High Lester UP MCP-HT450 made by Mitsubishi Yuka Kabusikikaisha with use of a probe UR-100 where the voltage of 1.0 kv is fed. As another example, a multi-layer structure can be used in which a base body of a conductive rubber having a volume resistivity from $10^4$ Ohm centimeters to $10^9$ Ohm centimeters and a thickness around 0.5 mm to 3 mm using EPDM, NBR, silicone rubber, chloroprene rubber, or epichlorhydrin rubber, etc. is reinforced with a core member having a certain mechanical strength, and in which a surface layer of high resistance or insulator using a fluoric resin having a thickness about 5 to 40 microns and a volume resistivity of $10^{12}$ Ohm centimeters or higher is provided.

As the first transfer roller 65*a*, 65*b*, a material of EPDM, NBR, silicone rubber, chloroprene rubber, or epichlorhydrin rubber, etc. having a volume resistivity from $10^4$ Ohm centimeters to $10^{10}$ Ohm centimeters can be used.

In this embodiment, as a material for the intermediate transfer belt 61, a PI resin having a thickness of about 70 microns with resistance adjustment such that the surface resistivity is of $10^{10}$ Ohm per square and the volume resistivity is $10^{10}$ Ohm centimeters. As a material for the first transfer rollers 65*a*, 65*b*, used is an epichlorhydrin rubber having a volume resistivity from $10^7$ Ohm centimeters to $10^8$ Ohm centimeters. The resistance of the transfer belt 61 is, in the same way as the above, the result measured using High Lester UP MCP-HT450 made by Mitsubishi Yuka Kabusiki-kaisha with use of a probe UR-100 where the voltage of 1.0 kv is fed.

As the photosensitive drums 1*a*, 1*b* used are organic photosensitive bodies (OPC) of a negative polarity, and using toners of negative polarity as toners of the respective colors, visualization is made by reverse development of the exposed portion with the laser and the respective toners.

As a method to position the toner images of the respective colors on the intermediate transfer belt 61 to match the position and to overlap the images, a mark 68 formed on the intermediate transfer belt 61 is read out by an optical sensor 69, and the read signal I-top (Image top) is made as reference, thereby writing the respective images on the photosensitive drums 1*a*, 1*b* after the prescribed timings.

During the execution period of the primary transfer operation, primary transfer bias voltages are applied with a power source 71*a* for the primary transfer roller 65*a* described above and a power source 71*b* for the primary transfer roller 65*b*. That is, the primary transfer bias voltage is applied from the power source 71*a* for the first color and the third color and from the power source 71*b* for the second color and the fourth color.

More specifically, in this embodiment, as the primary transfer bias voltage value for a preferable primary transfer made of the first color (yellow), the second color (magenta), the third color (cyan), and the fourth color (black) in this sequence, good transfer performance is obtained by setting the first color to be +600 V, the second color to be +800 V, the third color to be +100 V, and the fourth color to be +1200 V. The reason that the proper values of the primary transfer bias voltage are increasing sequentially in a manner thus described, is that the necessary transfer bias values are sequentially increased to correspond to increased impedances from the stacked toners where the toners are accumulated on the intermediate transfer belt 61 sequentially as going toward the further downstream side color. Also, as another reason, where the material of the intermediate transfer belt 61 is made of a member having a relatively high resistance, the intermediate transfer belt 61 itself tends to be charged up, and therefore, the increased amount may be further increased as going toward the further downstream side color.

In a meantime, the transfer bias of the first and third colors is applied to the primary transfer roller 65*a* at that time, and the transfer bias of the second and fourth colors is applied to the primary transfer roller 65*b*, so that the transfer biases of the first and second colors, the transfer biases of the second and third colors, the transfer biases of the third and fourth colors, the transfer biases of the fourth color and the first color of the subsequent page, which are respectively adjacent to each other, are possibly applied at the same time. With the same page, where the transfer biases of the nth color and n+1th color are applied at the same time, the bias values of both are not so much different from each other, and therefore, the bias voltages applied to the primary transfer rollers 65*a*, 65*b* do not practically interfere with each other via the intermediate transfer belt 61. Where the transfer bias of the fourth color for the present page and the transfer bias of the first color for the subsequent page are applied at the same time astride the page, however, the gap between both bias values is large, 1200 V−600 V=600 V, so that the bias voltage of the fourth color applied to the primary transfer roller 65*b* and the transfer bias voltage of the first color for the subsequent page applied to the primary transfer roller 65*a* do interfere with each other via the intermediate transfer belt 61, thereby causing image defects such that the image of the fourth color is of a transfer defect or that the first color image of the subsequent page is of a blurred image (e.g., extraordinary image due to discharge to the photosensitive drum or re-transfer) due to excessive transfer.

To solve this problem, in this embodiment, relations of the distance Lab in the rotation direction, the circumferential length Lr (for one rotation length), and the produced image length Lm, from the primary transfer position T1a of the photosensitive drum 1*a* in the first image production section A to the primary transfer position T1b of the photosensitive drum 1*b* in the second image production section B, are set as $$Lr-Lm>Lab \tag{1}$$

$$\rightarrow Lr-Lab>Lm$$

With these relations, the primary transfer of the first color for the subsequent print can be done after the primary transfer of the fourth color completely finishes, and therefore, the primary transfer biases of the fourth color and the first color of the subsequent print are prevented from interfering with each other.

Herein, the image length Lm is described. The images are preferably formed at entire regions of the transfer materials, and in fact, the images are formed nearly in the equal size to the size of the transfer material though creating some margins. In the description below, the image length Lm is presumed as the same as the length of the transfer material.

As apparent from the description above, Formula (1) is inevitably satisfied in the image formation on the transfer material having a length of the length Lm or less and satisfying Formula (1), and the formation can be done without any occurrence of interference between the primary transfer biases. Accordingly, with respect to Lm of the transfer material having the maximum length that can be printed at the apparatus, if Formula (1) is satisfied, the apparatus can correspond to all transfer materials. In general, image forming apparatuses are designed to use regular size papers according to the standard of the JIS (Japanese Industrial Standard) as most frequently used transfer materials. More specifically, there are roughly two types: A4 size (210 mm in the shorter edge length) and A3 size (420 mm in the shorter edge length). For the image forming apparatus corresponding to the A4 size, the Lm is set to 210 mm; for the image forming apparatus corresponding to the A3 size, the Lm is set to 420 mm; and Lr, Lab are selected as to satisfy Formula (1). Some apparatus may be designed to allow printing on a transfer material longer than the most frequently used transfer material. For example, it is the legal size (216 mm in the shorter edge length) in the image forming apparatus corresponding to the A4 size. In such a case, the Lm is set to 216 mm, thereby rendering the apparatus correspond to the legal size, but if the Lm is set larger, the circumferential length Lr of the intermediate transfer belt 61 becomes more longer, thereby rendering the apparatus larger consequently.

As one solution, the apparatus may be designed so that Formula (1) is satisfied with respect to the transfer materials most frequently used but with respect to the transfer materials larger than those, the primary transfer of the first color for the subsequent print is done after the intermediate transfer belt 61 is further rotated by one rotation to avoid interference between the primary transfer biases. With this control, the three rotations of the intermediate transfer belt 61 produce a full-color image of one sheet, and therefore, the printing speed becomes slower in comparison with the regular control in which the two rotations produce a full-color image of one sheet, but the apparatus can be prevented from formed larger in size.

In this embodiment, there is an advantage that interference during a transfer operation from the image carrying means to the intermediate transfer body and that the toner image forming position is immobilized on the intermediate transfer belt. That is, the interference prevention during transfer as the main advantage of this invention can be achieved without particularly manipulating the forming position of the toner image on the intermediate transfer body.

[Second Embodiment]

In the first embodiment, the apparatus is structured so that Lr−Lm >Lab . . . (1) is satisfied to prevent the transfer biases applied to the primary transfer rollers 65*a*, 65*b* from interfering with each other.

Meanwhile, in a case that the relations among the Lr, the Lm, and the Lab, are:

$$Lr-Lm \leqq Lab \quad (2),$$

the following is a method for preventing the primary transfer biases from interfering with each other. As described in the first embodiment, as a method to match and overlap the position of the toner images of the respective colors on the intermediate transfer belt 61, a mark 68 formed on the intermediate transfer belt 61 is read out by an optical sensor 69, and the read signal I-top (Image top) is made as reference, thereby writing the respective images on the photosensitive drums 1*a*, 1*b* after the prescribed timings.

In this embodiment, the timing from reception of the I-top signal to actual image exposure by laser beam on the photosensitive drums 1*a*, 1*b* is retarded by ΔT according to the sheet number for printing, and in other words, a method is described in which, where the necessary time for one rotation of the intermediate transfer belt 61 is set as T, the average print time is set as T+ΔT during successive printing operation.

More specifically, where the running speed of the intermediate transfer belt 61 is denoted as Vp, $$\Delta L = Vp \times \Delta T \quad (3)$$

and the timing of printing start of the nth and n+1th is shifted rearward by the length of ΔL with respect to one circumferential length of the intermediate transfer belt 61. At that time, where ΔL (or ΔT)is set to satisfy the following formula:

$$Lr-Lm > Lab + \Delta L \quad (4),$$

the primary transfer of the first color of the subsequent print can be done upon waiting for the completely finishing of the primary transfer of the fourth color, so that the primary transfer biases of the fourth color and the first color of the next print can be prevented from interfering with each other during the successive printing operation.

[Third Embodiment]

Next, a situation that the transfer material most frequently used and the transfer material larger than the material, both are used as described in the first embodiment, is described.

With respect to the transfer material most frequently used, as described in the first embodiment, the apparatus is structured as Formula (1) is satisfied, and during the successive printing operation, the image area is always set at the same position on the intermediate transfer belt 61. In other words, where the time needed for one rotation of the intermediate transfer belt 61 is set as T, the interval of the respective printing during the successive printing operation is desirably set as T, and with respect to the transfer materials larger than that material, it is designed so that Formula (2) and Formula (3) are satisfied and that the image area is shifted downward on the intermediate transfer belt 61 according to the printing sheet number.

With this control, the primary transfer biases of the fourth color and the first color of the next print can be prevented from interfering with each other during the successive printing operation, and with respect to the successive printing operation for the transfer materials having a larger size than the transfer material most frequently used, the intermediate transfer belt's rotation of the two rotations plus ΔT (time) brings one full-color image. Accordingly, as described in the first embodiment, the rotation amount of the intermediate transfer body is slightly increased in comparison with the operation in which one full-color image is obtained by the two rotations of the intermediate transfer body, but the image formation can be completed within the same time as in the first embodiment as a result, and the apparatus can be avoided from made larger.

[Fourth Embodiment]

Figure 2:
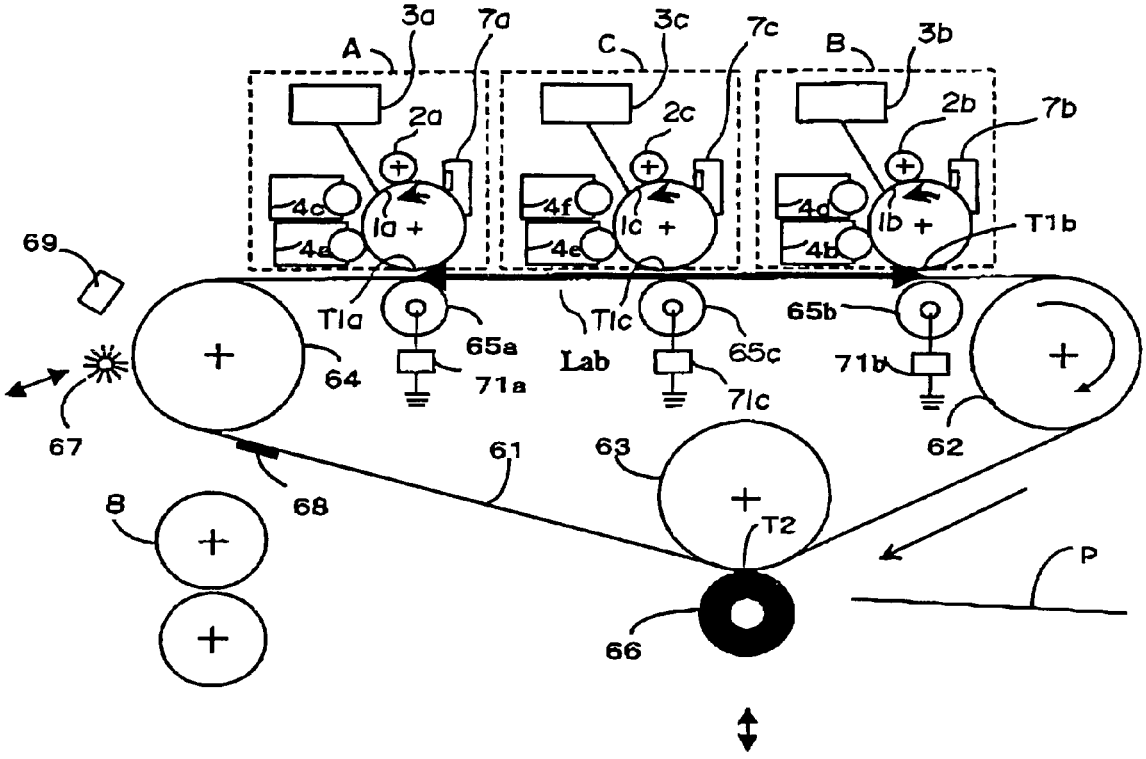
FIG. 2 is an illustration showing an image forming apparatus according to a fourth embodiment of the invention.

FIG. 2 shows the fourth embodiment of the invention. Members having the same structure and function as those in the embodiments described above are assigned with the same reference numbers, and duplicated descriptions are omitted. In this embodiment, described is an apparatus having three image carriers as image carrying means. This is because this invention has an advantage where the intermediate transfer body rotates in a plural number, regardless the number of the image carriers, as far as the carriers are provided in a plural number.

Recently, image improvement is performed using toners of four or more colors by reducing particle feeling on the images or by increasing the color area volume.

In this embodiment, presented is a case that the toner colors are six colors. The developing devices 4*a*, 4*b*, 4*c*, 4*d* contain the toners same as those in the embodiments described above, and the developing devices 4*e*, 4*f* contain light magenta and light cyan, respectively.

Color image formation done by overlapping the respective color toner images on the intermediate transfer belt 61 are the same as those in the first to third embodiments, but the respective images are written on the three photosensitive drums 1*a*, 1*b*, 1*c*.

During the execution period of the primary transfer operation, primary transfer bias voltages are applied with a power source 71*a* for the primary transfer roller 65*a* described above, a power source 71*b* for the primary transfer roller

65*b*, and a power source 71*c* for the primary transfer roller 65*c*. That is, the primary transfer bias voltage is applied from the power source 71*a* for the first color and the fourth color, from the power source 71*b* for the second color and the fifth color, and from the power source 71*c* for the third color and the sixth color.

The image production section having a first image carrier is denoted as A; the image production section having a second image carrier is denoted as B; the image production section having a third image carrier is denoted as C. The drive method of the intermediate transfer belt 61 and the detachably attaching operation of the secondary transfer roller 66 of this embodiment are the same as those in the embodiments above. However, the image production section C having the third image carrier is extra, and it is added between the image production section A having the first image carrier and the image production section B having the second image carrier.

The image production section C forms toner images to be overlapped with the toner images formed at the image production section A on the intermediate transfer belt 61, and the toner images formed at the image production section B are formed thereon. By two circulations, the toner images overlapping six-color toners are formed on the intermediate transfer belt 61.

With the image forming apparatus shown in FIG. 2, the same invention is embodied as the embodiments above. That is, the positional relation is defined so as not to make transfer of the toner image of the subsequent image at the same time as the toner image formed at the image production section C is re-transferred on the intermediate transfer belt 61. The positional relation is shown by Formulas (1) to (4). That is, by defining the distance Lab between the respective transfer positions onto the intermediate transfer belt 61 at the image production section A and the image production section B, and the circumferential length Lr of the intermediate transfer belt 61, any interference between the primary transfer biases are prevented in this embodiment, so that good images can be obtained.

[Fifth Embodiment]

Figure 3:
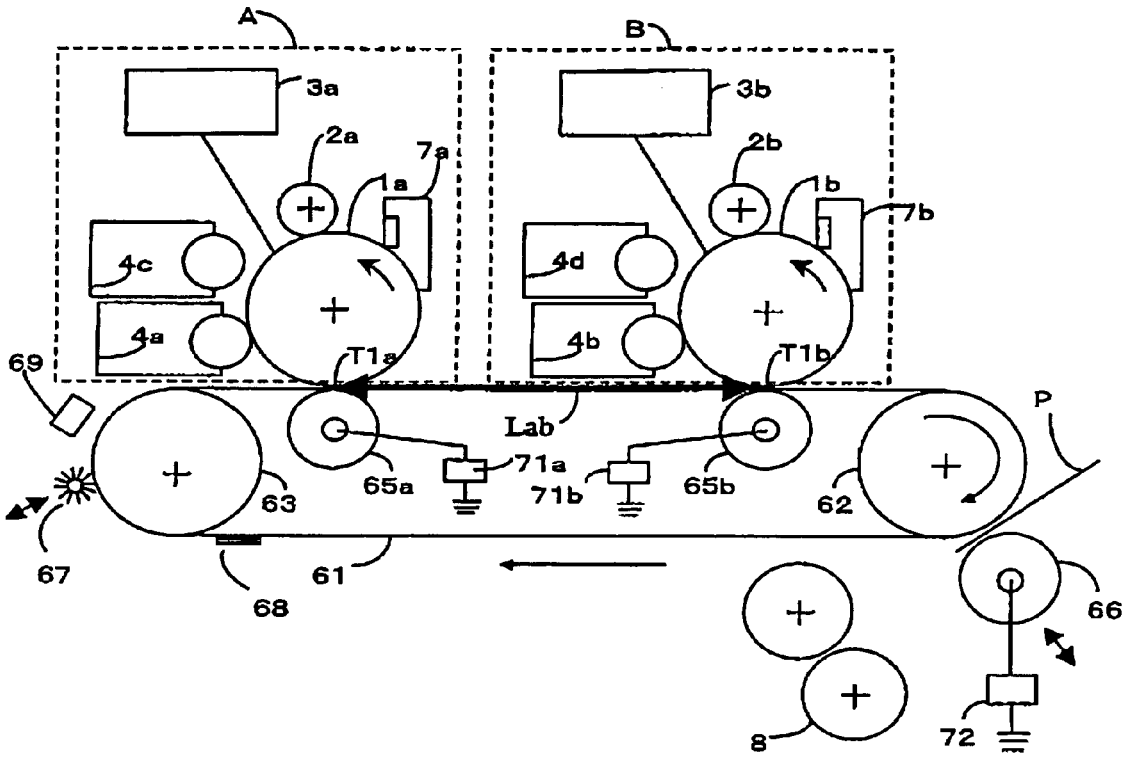
FIG. 3 is an illustration showing an image forming apparatus according to a fifth embodiment of the invention.
Figure 4:
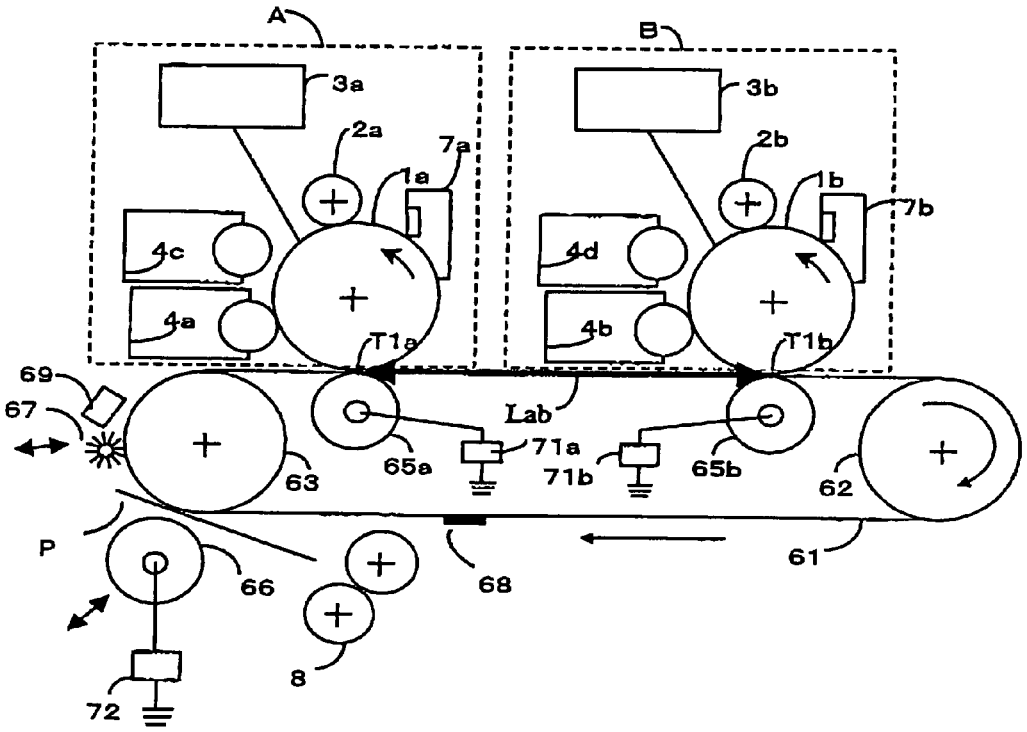
FIG. 4 is an illustration showing an image forming apparatus according to the fifth embodiment of the invention.
Figure 5:
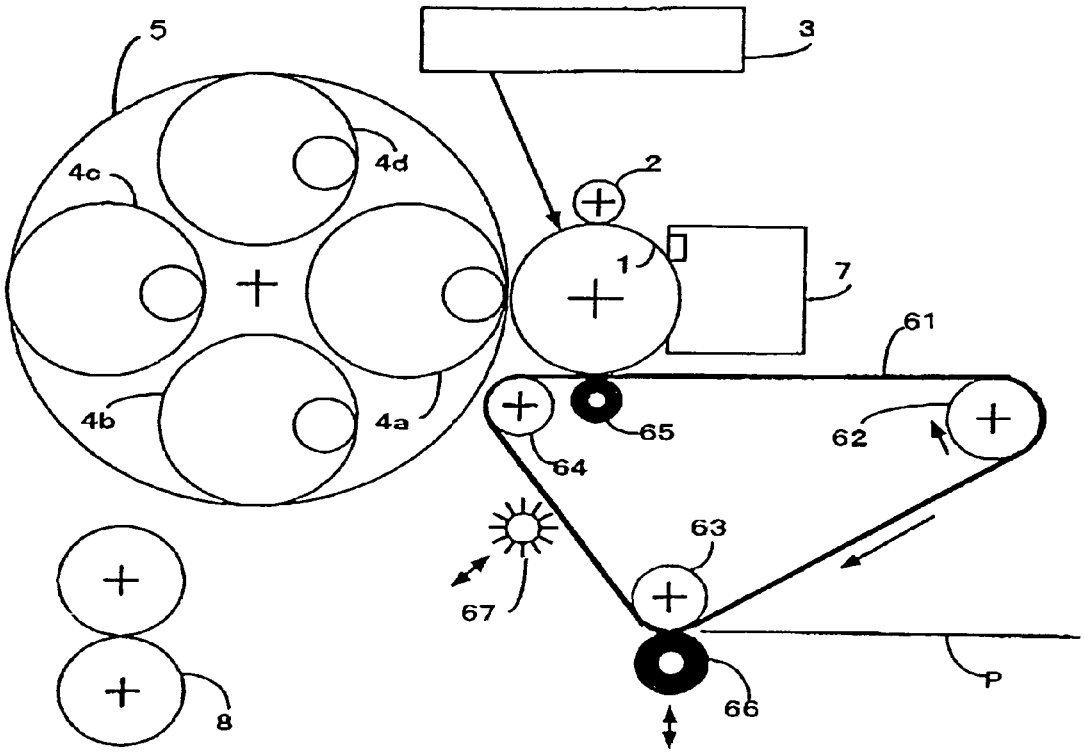
FIG.5 PRIOR ART
FIG. 5 is an illustration showing an image forming apparatus of a four-pass system as a prior art.

In the first to fourth embodiments as described above, the intermediate transfer belt 61 is tensioned with three rollers: a drive roller 62, a driven roller 63, and a tension roller 64, the descriptions are made according to the structural drawing in a case that the drive roller 62 is driven by a drive motor not shown, or namely a case that three-axis suspension supports the intermediate transfer belt 61. It is a matter of course, however, that the advantages of the invention are obtainable in the same way as those in the first and second embodiments even with a structure of a two-axis suspension in which the tension of the intermediate transfer belt 61 is directly adjusted between the drive roller 62 and the driven roller 63 in omitting the tension roller 64 as shown in FIG. 3 and FIG. 4. There are situations that reduction of the suspending roller number is needed or that it is advantageous to adapt a structure of the two-axis suspension from a viewpoint to unit layout design. However, in general, there is a tendency that the secondary transfer roller 66 and the primary transfer roller 65*a* or 65*b* are located adjacently, the secondary transfer bias voltage and the primary transfer bias voltage are interfered with each other, if the transfer material has a small volume resistivity. To solve this problem, where the primary transfer is done at the image production section and the image production section, it is structured that no secondary transfer is necessarily done at the same time, and preferably, the apparatus has a structure that the image length is ensured between the primary transfer section and the secondary transfer section. Alternatively, where the secondary transfer bias is necessarily applied to the secondary transfer section while the toner image is transferred at a certain primary transfer section, a conceivable method is that the secondary transfer bias is continually applied until the completion of the primary transfer where the secondary transfer bias is applied even prior to the start of the toner image transfer at the primary transfer section. In this case, however, presumed is interference between the primary transfer section and the secondary transfer section, and it is necessary, for design, that an increased portion caused by the interference from the secondary transfer bias is presumed where the transfer voltage of the primary transfer section is set previously at a lower voltage.

As described above, according to the embodiments, where the image carrying means is made of the plural image carriers, any interference from the image carrying means to the intermediate transfer body during transfer is prevented, and good images can be obtained. The apparatus can be provided with a smaller size and lower costs. With respect to interference, although in the above embodiments mainly described are interferences done by the transfer biases, the interference is not limited to those, and it is advantageous against other interferences such as vibrations transmitting through the intermediate transfer belt and noises generated when the transfer bias is turned on and off.

In the above embodiments, exemplified are printers as the image forming apparatuses, but this invention is not limited to those. For example, the image forming apparatus can be other image forming apparatuses such as a photocopier, a facsimile machine or other image forming apparatuses such as complex machines having combines functions as the above, and substantially the same advantages are obtainable where the invention applies to those image forming apparatuses.

Although various embodiments of the invention are described, the subject matter and the scope of the invention is not restricted to any particular descriptions in this specification or the attached drawings. For example, the intermediate transfer body is not necessarily a belt body, and this invention is applicable to an image forming apparatus utilizing an intermediate transfer drum.

What is claimed is:

1. An image forming apparatus comprising:

image carrying members; and an intermediate transfer body in an endless shape movable and receivable of toner images from said image carrying members at first and second transfer positions, wherein a toner image formed on said intermediate transfer body is transferred onto a transfer material after passing said first transfer position and said second transfer position again, wherein said first transfer position is a position for transferring to said intermediate transfer body from a nearest image carrying member on a downstream side in a moving direction of said intermediate transfer body with respect to a position that the toner image is transferred from said intermediate transfer body to the transfer material, wherein said second transfer position is a position for transferring to said intermediate transfer body from said nearest image carrying member on an upstream side in the moving direction of said intermediate transfer body with respect to a position that the toner image is transferred from said intermediate transfer body to the transfer material, and wherein the following relationship is satisfied where a distance from said first transfer position to said second transfer position along the moving direction of said intermediate transfer body is denoted as Lab, a circumference of said intermediate transfer body in the moving direction is denoted as Lr, and a maximum length of said toner image formed on said intermediate transfer body is denoted as Lm:

$$Lr-Lm>Lab,$$

wherein a toner image of an image is transferred onto said intermediate transfer body after toner images of the previous image are entirely formed on said intermediate transfer body where the toner images are formed successively.

2. The image forming apparatus according to claim 1, wherein a toner image forming position on said intermediate transfer body is immobilized in the moving direction of said intermediate transfer body where the toner images are formed successively.

3. The image forming apparatus according to claim 1, wherein said intermediate transfer body has a surface resistivity from $10^7$ Ohm per square (Ω/□) to $10^{12}$ Ohm per square (Ω/□).

4. An image forming apparatus according to claim 1, wherein a cleaning device is disposed at a certain position around said intermediate transfer body.

5. The image forming apparatus comprising:

image carrying members; and an intermediate transfer body in an endless shape movable and receivable of toner images from said image carrying members at first and second transfer positions, wherein a toner image formed on said intermediate transfer body is transferred onto a transfer material after passing said first transfer position and said second transfer position again, wherein said first transfer position is a position for transferring to said intermediate transfer body from a nearest image carrying member on a downstream side in a moving direction of said intermediate transfer body with respect to a position that the toner image is transferred from said intermediate transfer body to the transfer material, wherein said second transfer position is a position for transferring to said intermediate transfer body from said nearest image carrying member on an upstream side in the moving direction of said intermediate transfer body with respect to a position that the toner image is transferred from said intermediate transfer body to the transfer material, wherein the following relationship is satisfied where a distance from said first transfer position to said second transfer position along the moving direction of said intermediate transfer body is denoted as Lab, a circumference of said intermediate transfer body in the moving direction is denoted as Lr, and a maximum length of said toner image formed on said intermediate transfer body is denoted as Lm:

$$Lr-Lm>Lab, \text{ and}$$

wherein a toner image forming position on said intermediate transfer body is moved on a downstream side in the moving direction of said intermediate transfer body at each image formation where the toner images are formed successively.

6. An image forming apparatus comprising:

image carrying members; and an intermediate transfer body in an endless shape movable and receivable of toner images from said image carrying members at first and second transfer positions, wherein a toner image formed on said intermediate transfer body is transferred onto a transfer material after passing said first transfer position and said second transfer position again, wherein said first transfer position is a position for transferring to said intermediate transfer body from a nearest image carrying member on a downstream side in a moving direction of said intermediate transfer body with respect to a position that the toner image is transferred from said intermediate transfer body to the transfer material, wherein said second transfer position is a position for transferring to said intermediate transfer body from the nearest image carrying member on an upstream side in the moving direction of said intermediate transfer body with respect to a position that the toner image is transferred from said intermediate transfer body to the transfer material, wherein the following relationship is satisfied where a distance from said first transfer position to said second transfer position along the moving direction of said intermediate transfer body is denoted as Lab, a circumference of said intermediate transfer body in the moving direction is denoted as Lr, and a maximum length of said toner image formed on said intermediate transfer body is denoted as Lm:

$$Lr-Lm\leqq Lab,$$

wherein a toner image forming position on said intermediate transfer body is moved on an upstream side in the moving direction of said intermediate transfer body at each image formation where the toner images are formed successively, and wherein a toner image of an image is transferred onto said intermediate transfer body after toner images of the previous image are entirely formed on said intermediate transfer body where the toner images are formed successively.

7. The image forming apparatus according to claim 6, wherein said intermediate transfer body has a surface resistivity from $10^7$ Ohm per square (Ω/□) to $10^{12}$ Ohm per square (Ω/□).

8. An image forming apparatus according to claim 6, wherein a cleaning device is disposed at a certain position around said intermediate transfer body.

9. An image forming apparatus comprising:

image carrying members; and an intermediate transfer body in an endless shape movable and receivable of toner images from said image carrying members at first and second transfer positions, wherein a toner image formed on said intermediate transfer body is transferred onto a transfer material after passing said first transfer position and said second transfer position again, wherein said first transfer position is a position for transferring to said intermediate transfer body from a nearest image carrying member on a downstream side in a moving direction of said intermediate transfer body with respect to a position that the toner image is transferred from said intermediate transfer body to the transfer material, wherein said second transfer position is a position for transferring to said intermediate transfer body from the nearest image carrying member on an upstream side in the moving direction of said intermediate transfer body with respect to a position that the toner image is transferred from said intermediate transfer body to the transfer material, wherein the following relationship is satisfied where a distance from said first transfer position to said second transfer position along the moving direction of said intermediate transfer body is denoted as Lab, a circumference of said intermediate transfer body in the moving direction is denoted as Lr, and a maximum length of said toner image formed on said intermediate transfer body is denoted as Lm:

$Lr-Lm \leqq Lab$, and wherein a toner image forming position on said intermediate transfer body is moved on a upstream side in the moving direction of said intermediate transfer body so that distance between a first toner image and a second toner image is larger than the length Lab at each image formation where the toner images are formed successively.

* * * * *

UNITED STATES PATENT AND TRADEMARK OFFICE

CERTIFICATE OF CORRECTION

PATENT NO. : 7,010,254 B2
APPLICATION NO. : 10/743405
DATED : March 7, 2006
INVENTOR(S) : Akihiko Takeuchi et al.

It is certified that error appears in the above-identified patent and that said Letters Patent is hereby corrected as shown below:

ON THE COVER PAGE:

UNDER REFERENCES CITED, ITEM (56):

"2002214872" should read --2002-214872--.

IN THE ABSTRACT, ITEM (57):

Line 11, "Lm-Lr-Lm>Lab." should read --Lm: Lr-Lm<Lab.--.

COLUMN 1:

Line 18, "as" should read --so as--.

COLUMN 2:

Line 13, "an" should be deleted.

COLUMN 4:

Line 52, "poly carbonate," should read --polycarbonate,--; and
Line 59, "Kabushikikaisha" should read --Kabushiki Kaisha--.

UNITED STATES PATENT AND TRADEMARK OFFICE

CERTIFICATE OF CORRECTION

PATENT NO. : 7,010,254 B2
APPLICATION NO. : 10/743405
DATED : March 7, 2006
INVENTOR(S) : Akihiko Takeuchi et al.

It is certified that error appears in the above-identified patent and that said Letters Patent is hereby corrected as shown below:

COLUMN 5:

Line 17, "Kabusiki-" should read --Kabushiki- --; and
Line 18, "kaisha" should read --Kaisha--.

Signed and Sealed this

Twenty-second Day of August, 2006

JON W. DUDAS
*Director of the United States Patent and Trademark Office*